United States Patent [19]

Kobayashi

[11] Patent Number: 4,633,618

[45] Date of Patent: Jan. 6, 1987

[54] LENS GRINDING APPARATUS

[75] Inventor: Takahide Kobayashi, Kawasaki, Japan

[73] Assignee: Koken Co., Kanagawa, Japan

[21] Appl. No.: 689,240

[22] Filed: Jan. 7, 1985

[30] Foreign Application Priority Data

Jan. 14, 1984 [JP] Japan ..... 59-005342

[51] Int. Cl.[4] ..... B24B 9/14

[52] U.S. Cl. ..... 51/101 LG; 51/165 TP; 51/165.72

[58] Field of Search ..... 51/101 LG, 165 TP

[56] References Cited

U.S. PATENT DOCUMENTS

| | | | |
|---|---|---|---|
| 3,555,739 | 1/1971 | Novak | 51/101 LG |
| 3,786,600 | 1/1974 | Bloxsom | 51/101 LG |
| 4,096,684 | 6/1978 | Akaba | 51/101 LG |
| 4,517,870 | 5/1985 | Kopp | 51/101 LG |

*Primary Examiner*—Harold D. Whitehead

*Attorney, Agent, or Firm*—Cushman, Darby & Cushman

[57] ABSTRACT

An improved lens grinding apparatus of the type including a grinding wheel for grinding lens blank, a wheel shaft for mounting the grinding wheel and two lens shafts adapted to rotatably clamp lens blank therebetween. The apparatus further includes a writing device for scribing a band of magnetized zone on the magnetic sheet by means of a writing magnet on the free end of the first arm, a reading device for reading the contour line of the magnetized zone by means of hole elements on the second arm and a center distance changing device for changing the center distance between the wheel shaft and the lens shafts in response to changing of the configuration of the contour line. These devices are operatively associated with one another and operations of each of them are controlled by a control system. The magnetic sheet is first magnetized to a certain polarity by a demagnetizing magnet and the magnetized zone is then magnetized to another polarity by a writing magnet on the first arm which is located in alignment with the follower roller adapted to contact with the V-shaped groove of a lens frame. The center distance changing device includes a moving block which is operatively connected to the lens shaft. One of two motors on the moving block has an output shaft which serves to turn the second arm.

11 Claims, 6 Drawing Figures

LENS GRINDING APPARATUS

BACKGROUND OF THE INVENTION

1. Field of the Invention

The present invention relates to an apparatus for grinding a lens blank and more particularly to a lens grinding apparatus of the type including. means for storing the configuration of a lens frame.

2. Description of the Prior Art

A conventional method of manufacturing lenses is generally carried out by way of the step of first preparing an original pattern or master pattern on the basis of a certain lens frame on the pattern making machine and then mounting it on the contour carrying machine to grind a lens blank to the predetermined configuration corresponding to that of the V-shaped groove of a lens frame. However, it has been pointed out as drawbacks of the conventional method that it requires a large cast for installing manufacturing facilities particularly because of the necessity for the pattern making machine to prepare an original pattern from the lens frame. It takes a large amount of manpower and a long time because of the necessity for preparing the original pattern on the pattern making machine, manufacturing of lenses is achieved only at a very low operational efficiency and a lens blank cannot be ground precisely due to the frequent occurrence of dimensional error during preparation of the original pattern on the pattern making machine. To obviate the drawbacks as described above there has been previously proposed lens working apparatuses for grinding lens blanks while using a lens frame as a contour copying means. For instance, the applicant of the present invention invented an improvement of so-called direct copying type lens working apparatus as disclosed in Japanese Publication Patent No. 46817/1980 and 46818/1980 in which grinding of lens blanks is carried out while using a lens frame. It has been found that this improved apparatus brings high economy and excellent working accuracy and efficiency for a grinding operation.

However, the above-mentioned direct copying type lens working apparatus still has the following problems to be solved. Namely, when a metal frame widely used for eye glasses in recent years is employed for a lens frame, a follower roller on the copying arm is often disengaged from the frame due to abutment against the stepped portion on the junction area of the fgrame during the grinding operation of lens blank with the use of lens frame as contour copying means. As a result, the grinding operation is carried out at a reduced operational efficiency and therefore the lens blanks cannot be often reused. Thus, they are thrown away as refected goods. Further, a ground lens cannot always be tightly fitted to a lens frame when the grinding wheel wears irregularly or excessively. In this case, so-called repeated grinding operation is required which includes the steps of adjusting the center distance between the lens shafts and the wheel shaft on the lens working apparatus and then grinding the lens blank again. When a repeated grinding operation is carried out on the direct copying type lens working apparatus, it is necessary that the lens frame which has been removed from the lens working apparatus is reset to the latter and the lens blank is then mounted thereon. However, the resetting operation of the lens frame at the same position in the same direction after removal from the apparatus in that way requires highly trained skill and much time, but fails to assure excellently high fitting accuracy. Therefore, when repeated grinding operations are carried out on the direct copying type lens working apparatus, sufficiently high grinding accuracy cannot be expected.

SUMMARY OF THE INVENTION

Thus, the present invention has been made with the foregoing background in mind and its object resides in providing an improved lens grinding apparatus which assures that the grinding operation is repeatedly carried out in accordance with information magnetically stored with respect to the configuration of a lens frame ensuing high grinding accuracy, economy and operative efficiency.

To accomplish the above object there is proposed according to the invention an improved lens grinding a apparatus for grinding lens blank to the predetermined configuration of a lens frame to which a ground lens is to be fitted later. The apparatus is of such a type that it includes a grinding wheel adapted to be rotated at a higher rotational speed to grind lens blank, a wheel shaft for mounting the grinding wheel thereon and two lens shafts adapted to clamp the lens blank therebetween. The axis of the lens shafts extending in parallel with the axis of the wheel shaft and rotates at a lower rotational speed and at least one of the wheel shaft and the lens shafts is adapted to move toward and away from the other one. The improvement consists in that it further includes a writing device for scribing a band of a magnetized zone on a magnetic sheet while a follower roller on a first arm rolls on the V-shaped groove of the lens frame. The magnetized zone has a contour line corresponding to the configuration of the V-shaped groove of the lens frame. The improvement further includes a reading device for reading the contour line of the magnetized zone on the magnetic sheet by means of a plurality of hole elements on a second arm, a center distance changing device for changing the center distance between both the wheel shaft and the lens shafts in response to changing of the configuration of the contour line read by the reading device, and a control system for controlling operations of each of the devices.

According to the invention the writing device includes a first arm and a third arm. The first arm is turnably supported on the apparatus to turn between the waiting position located outwardly of the contour line and the waiting position where the magnetic sheet is magnetized to a certain polarity by means of a writing magnet carried on the free end of the first arm to scribe a band of magnetized zone. The third arm is turnably supported on the apparatus to turn between the waiting position located outwardly of the magnetic sheet and the waiting position located at the center of the magnetic sheet to magnetize the magnetic sheet to another polarity which is reverse to the first mentioned polarity and comprises a demagnetizing magnet.

The writing magnet carried on the first arm is located in alignment with the follower roller adapted to roll on the V-shaped groove of the lens frame and has the same diameter as that of the follower roller. The configuration of the contour line of the magnetized zone corresponds to the lens frame.

Usually, the magnetic sheet is first magnetized to the last mentioned polarity by means of the demagnetizing magnet of the third arm. It is then magnetized to the first mentioned polarity by means of the writing magnet on the first arm.

The reading device includes a first hole element attached to the one bifurcated end part of the second arm to detect movement of the latter in the axial direction. A second hole element is attached to the other bifurcated end part of the second arm to detect turning movement of the latter. Specifically, the first hole element is located in parallel with the magnetic sheet and includes an opposing pair of input electrodes located in the longitudinal direction of the second arm and an opposing pair of output electrodes located in the transverse direction of the same. The second hole element is located at a right angle relative to the magnetic sheet and includes an opposing pair of input electrodes located in the longitudinal direction of the second arm and an opposing pair of output electrodes located in the direction at a right angle relative to the same.

Further, the center distance changing device includes a moving block with a motor mounted thereon to displace the lens blank toward and away from the grinding wheel and an output shaft for turning the second arm. The the one lens shaft is rotatably fitted to the output shaft.

The output shaft is operatively connected to another motor which is mounted on the moving block to turn the second arm.

Other objects, features and advantages of the invention will become more clearly apparent from reading the following description which has been prepared in conjunction with the accompanying drawings.

BRIEF DESCRIPTION OF THE DRAWINGS

The accompanying drawings will be briefly described below.

DESCRIPTION OF THE PREFERRED EMBODIMENTS

Now, the present invention will be described in a greater detail hereunder with reference to the accompanying drawings which illustrate preferred embodiment thereof.

Figure 1:
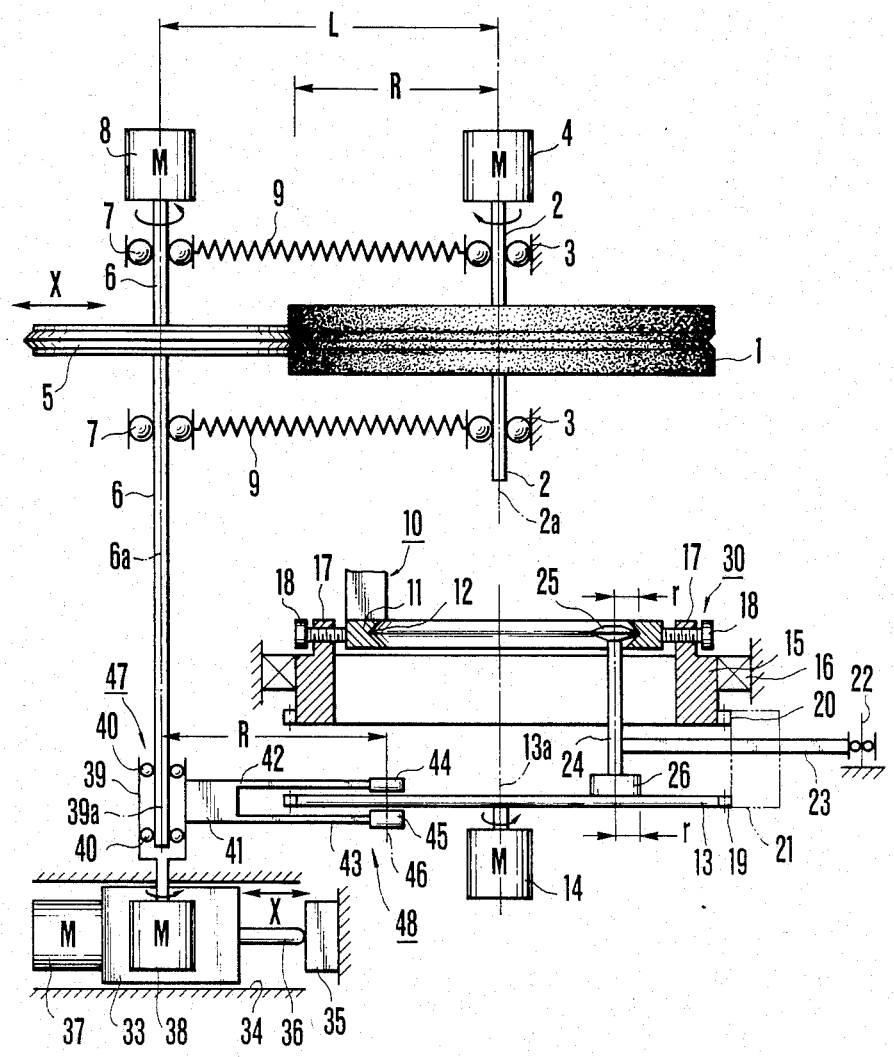
FIG. 1 is a schematic vertical sectional view of a lens grinding apparatus according to a preferred embodiment of the invention, illustrating arrangement of essential components constituting the apparatus.

FIG. 1 schematically illustrates a lens grinding apparatus according to an embodiment of the invention. In the drawing reference numeral 1 designates a grinding a wheel for grinding lens blank. The grinding wheel 1 is fixedly mounted on a shaft 2 which is rotatably supported by means of bearings 3 to rotate at a high rotational speed, for instance, 3,500 rpm with the aid of a motor 4. Further, reference numeral 5 designates a lens blank. The lens blank 5 is firmly held by means of shafts 6 of which axis 6*a* extends in parallel with the axis 2*a* of the wheel shaft 2. The lens shafts 6 are rotatably supported by means of bearings 7 to rotate at a lower speed, for instance, 6 rpm with the aid of a motor 8. It should be noted that the lens shafts 6 are constructed such that the lens blank 5 is held between both ends of two lens shafts which are located in alignment with one another to rotate the lens blank 5 (for the purpose of simplification of explanation the whole structure as mentioned above is herein called as lens shaft).

To allow the center distance L between the wheel shaft 2 and the lens shaft 6 to be changed while they are kept in the parallel relation, at least one of the wheel shaft 2 and the lens shaft 6 can be displaced in the X direction. In the illustrated embodiment the wheel shaft 2 is immovably mounted and the lens shaft 6 is displaceably mounted to move in the X direction toward and away from the wheel shaft 2 with the aid of guiding means (not shown). The lens shaft 6 is normally biased toward the wheel shaft 2 under the effect of the resilient force of springs 9 to apply grinding pressure to the grinding wheel.

Next, reference numeral 10 designates a lens rim. The lens rim 10 includes a lens frame 11 which is formed with a V-shaped groove 12 on the inner surface thereof to which the circumferential rib of lens, that is, the projected portion along the edge of lens is to be fitted later. Reference numeral 13 designates a magnetic sheet which serves to represent the configuration corresponding to the V-shaped groove 12 on the lends frame 11. The magnetic sheet 13 is rotated about the axis 13*a* by means of a motor 14 adapted to be operated in synchronization with the motor 8. The axis 13*a* of the magnetic sheet 13 is located on the extension line from the axis 2*a* of the wheel shaft 2. An annular frame holder 15 is rotatably supported by means of a bearing 16 at the position where the extension line, from the axis 13*a* of the magnetic sheet 13 assumes the center of rotation. The frame holder 15 has a plurality of brackets 17 projected from the side thereof and screws 18 are threadably fitted through the brackets 17 to firmly hold the lens frame 11 with the foremost ends of the screws 18. Arrangement is made such that the frame holder 15 is rotated in synchronization with rotation of the magnetic sheet 13. In the illustrated embodiment geared portions 19 and 20 having the same diameter are provided on the outer circumference of the magnetic sheet 13 and that of the frame holder 15 at the lower end thereof as seen in the drawing so that a pinion 21 comes in meshing engagement to both the geared portions 19 and 20. As modification from the arrangement made in the above-described manner the geared portion 20 of the frame holder 15 may be rotated by means of a synchronous motor adapted to be operated in synchronization with the motor 14. In this case the geared portion 19 of the magnetic sheet 13 is not required.

Figure 2:
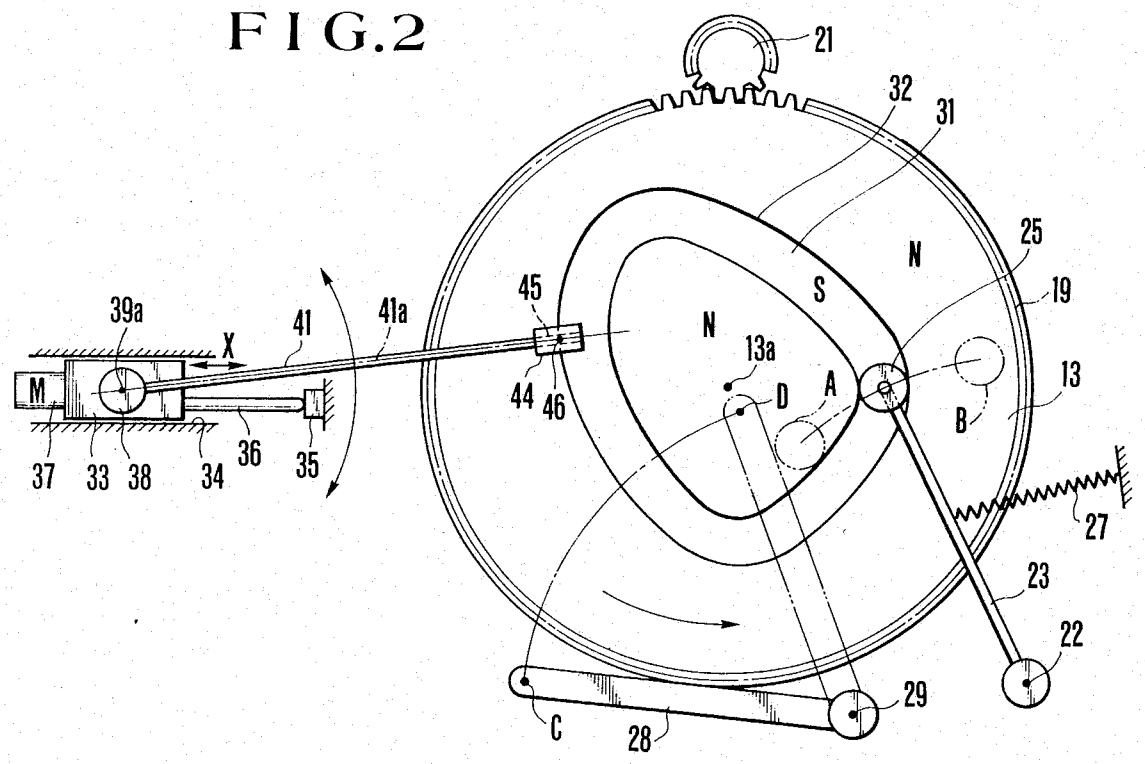
FIG. 2 is a plan view of the lens grinding apparatus illustrating a magnetic sheet and associated components.

FIG. 2 is a plan view illustrating the magnetic sheet 13 and associated components. As illustrated in FIGS. 1 and 2, a first arm 23 is disposed turnable about the axis 22 in the plane extending in parallel with the magnetic sheet 13. The axis 22 of the first arm 23 is located outwardly of the magnetic sheet 13 by a certain distance. The first arm 23 carries a rod 24 at the foremost end thereof. The rod 24 extends at a right angle relative to the first arm 23 and a follower roller 25 is rotatably supported at the upper end of the rod 24. The follower roller 25 has a diameter r smaller than the minimum radius $r_o$ of curvature existent in the configuration of the lens frame 11 and it is located at the height level where it rolls along the V-shaped groove 12 of the lens frame 11 which is held in position within the frame holder 15. Further, a writing magnet 26 having the same diameter as that of the follower roller 25 is attached to the lower end of the rod 24. The writing magnet 26 is located at the level height where it moves along the magnetic sheet 13 to magnetize the latter. The extent of turning movement of the first arm 23 is as determined by two extreme end points A and B in FIG. 2 and it is normally biased toward the outer end point B under the effect of resilient force of a coil spring 27. The inner end position A represents a position where the follower roller 25 is caused to move inwardly of the configuration corresponding to the minimum frame 11. Further, reference numeral 28 designates a demagnetizing magnet in the form of an arm having a reverse polarity to that of the writing magnet 26. As is apparent from the drawing, the demagnetizing magnet 28 is supported turnable about the axis 29 and the extent of turning movement thereof is determined by two points, that is, waiting position C and working position D as illustrated in FIG. 2. Thus, a contour line writing device 30 is constituted by these components as described above.

Next, operation of the contour line writing device 30 will be described below. While the first arm 23 is located at the waiting position A, the lens frame 11 is fitted to the frame holder 15 and the demagnetizing magnet 28 is located at the working position D, the magnetic sheet 13 is rotated by one revolution, causing it to be magnetized with the same polarity, for instance, north polarity. Next, the demagnetizing magnet 28 is turned to the waiting position C and the first arm 23 is caused to operate under the effect of a resilient force of the spring 27. Thus, the follower roller 25 is brought in pressure contact with the V-shaped groove 12 of the lens frame 11. When the magnetic sheet 13 and the frame holder 15 are rotated while they are operatively synchronized with one another, the follower roller 25 rolls along the configuration of the V-shaped groove 12 and thereby the writing magnet 26 scribes a magnetized pattern, that is, a band of magnetized zone 31 magnetized with south polarity on the magnetic sheet and having a width equal to the diameter $2r$ of the writing magnet 26. Since the radius of the writing magnet 26 is determined equal to that of the follower roller 25 and both the writing magnet 26 and the follower roller 25 are mounted on the same axis, the outer contour line of the magnetized zone 31, that is, the boundary line between the south polarity area of the magnetized zone 31 and the north polarity area on the magnetic sheet 13 located outside the latter, represents a contour line 32 corresponding to the configuration of the V-shaped groove 12 on the lens frame 11.

In FIGS. 1 and 2 reference numeral 33 designates a moving block adapted to move in the X direction with the aid of a guide 34. The block 33 includes a thrust rod 36 which abuts against a stationary member 35 and the thrust rod 36 is adapted to adjust the length of projection from the block 33 by operating a servomotor 37 mounted on the latter. Further, the moving block 33 has another servomotor 38 mounted thereon which includes an output shaft 39 of which axis **39*a* is located on the extension line from the axis 6*a* of the lens shaft 6. As illustrated in FIG. 1, the lens shaft 6 is rotatably inserted into the output shaft 39 with bearings 40 interposed therebetween. A second arm 41 is projected from the output shaft 39 in the radial direction on the substantially same plane as the magnetic sheet 13. The fore end part of the second arm 41 is bifurcated in such a manner as to hold the magnetic sheet 13 between both the bifurcated end parts of the second arm 41. The one bifurcated end part 42 of the second arm 41 located above the magnetic sheet 13 carries a hole element 44 for detecting movement of the second arm in the axial direction, whereas the other bifurcated end part 43 located below the magnetic sheet 13 carries a hole element 45** for detecting turning movement of the second arm.

Figure 3:
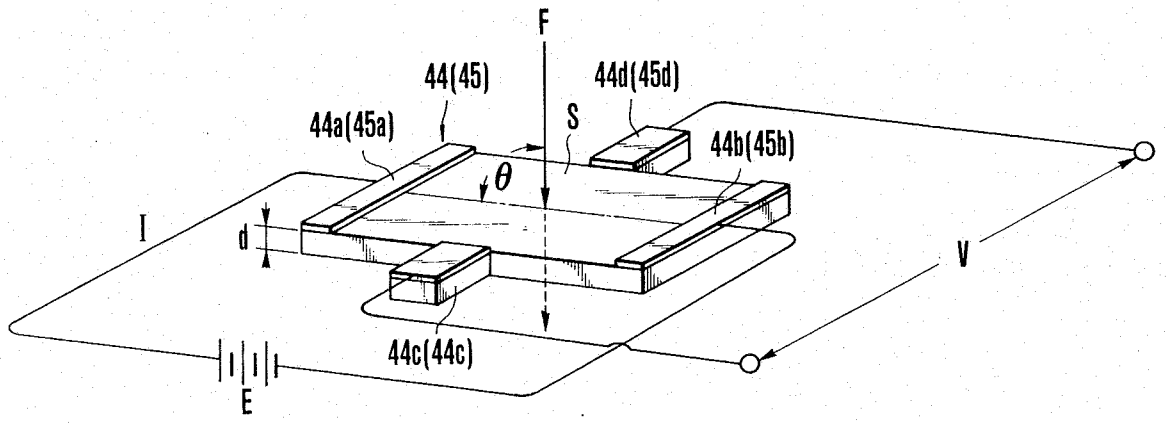
FIG. 3 is an enlarged perspective view of a hole element for the lens grinding apparatus.

Each of the hole elements 44 and 45 comprises a semiconductor element which functions in accordance with the hole effect. Incidentally, output voltage V from a hole element having a thickness D and constructed as illustrated in FIG. 3 will be represented by the following formula, when current I is transmitted to semiconductor S from power source E while the surface of the semiconductor S is located with magnetic flux F, $$F = \frac{R}{d} I B \cos\theta + k I$$

where R is hole coefficient, $\theta$ is angle formed by a combination of the plane of hole element and the direction of propagation of magnetic flux and k is unbalance coefficient.

Figure 4:
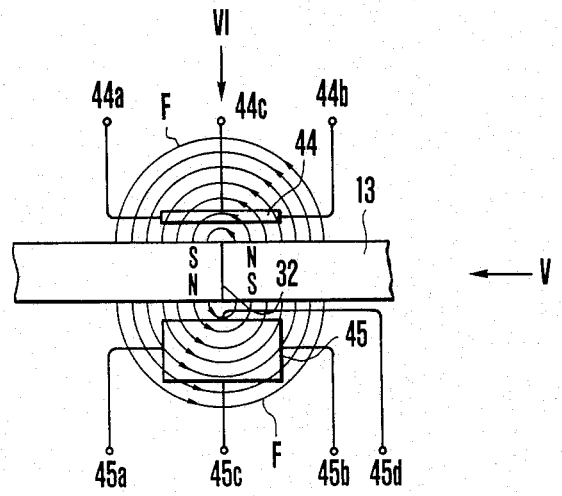
FIG. 4 is a fragmental front view of the lens grinding apparatus, particularly illustrating how hole elements are arranged relative to the magnetic sheet.
Figure 5:
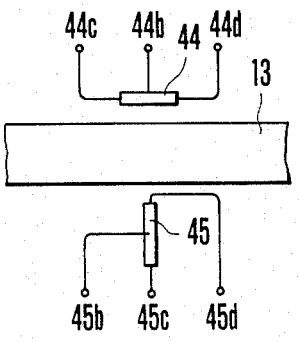
FIG. 5 is another fragmental front view of the lens grinding apparatus as seen in the direction as identified by an arrow mark V in FIG. 4.
Figure 6:
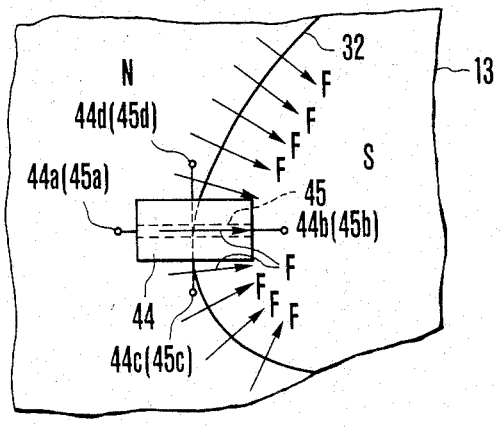
FIG. 6 is a fragmental plan view of the lens grinding apparatus as seen in the direction as identified by an arrow mark VI in FIG. 4.

As illustrated in FIGS. 4 to 6, the hole element 44 is arranged on the foremost end part of the second arm 41 in parallel with the magnetic sheet 13 in such a manner that two input electrodes **44*a* and 44*b* are located in the longitudinal direction of the second arm 41 and two output electrodes 44*c* and 44*d* are located in the transverse direction relative to the second arm 41. Thus, as the servomotor 37 is controlled to displace the second arm 41 forward and backward in the X direction in dependence on output voltage from the hole element 44 to generate output at the zero level, the hole element 44 is caused to assume the position in parallel with the magnetic field on the magnetic sheet 13. As a result, the hole element 44 can represent geometrical configuration of the contour line 32**.

Further, as illustrated in FIGS. 4 to 6, the hole element 45 is arranged on the foremost end part of the second arm 41 at a right angle relative to the magnetic sheet 13 in such a manner that two input electrodes **45*a* and 45*b* are located in the longitudinal direction and two output electrodes 45*c* and 45*d* are located at a right angle relative to the second arm 41. Thus, as the servomotor 38 is controlled to turn the second arm 41 in dependence on the output voltage from the hole element 45 to reduce the angle of $\theta$ to zero, the hole element 45 is caused to assume the position in parallel with the magnetic field on the magnetic sheet 3. As a result, the hole element 45 and the axis 41*a* of the second arm 41 extending in the same direction as that of the hole element 45 can assume the position located on the normal line extending from the contour line 32**.

Thus, a detection line 46 formed by both the hole elements 44 and 45, follows the contour line 32 and the axis **41*a* of the second arm 41 is located on the normal line extending from the contour line 32. It should be noted that the length of the second arm 41, that is, the distance between the detection line 46 and the axis 39*a* of the output shaft 39 is equal to the radius R of the grinding wheel 1. When the magnetic sheet 13 is rotated while the above-mentioned positional state is maintained, the detection line 46 on the second arm 41 follows the contour line 32 whereby the distance L between the lens shaft 6 and the wheel shaft 2 varies in response to variation of configuration of the contour line 32. Thus, while rotation of the lens blank 5 with the aid of the motor 8 is kept in synchronization with rotation of the magnetic sheet 13 with the aid of the motor 14, the lens blank 5 is ground to the same configuration as that of the contour line 32 by means of the grinding wheel which is rotating at a high rotational speed. Since the axis 41***a* of the second arm 41 is normally located on the normal line extending from the contour line 32 as described above, it is assured that the lens blank 5 adapted to move toward or away from the grinding wheel 1 in operative association with the second arm 41, is ground at a high dimensional accuracy without any fear of causing interferrence with the grinding wheel 1.

In the apparatus of the invention a reading device 47 is constituted by components in the area as defined between the moving block 33 and the hole elements 44 and 45. A center distance changing device 48 is constituted by components inclusive the bearings 40 which allow the output shaft 39 and the lens shaft 6 to be supported displaceable in the X direction and rotatable relative to one another. However, it should of course be understood that the present invention should not be limited only to the above-described embodiment. Alternatively, any center distance changing device will be accepted which is constructed so as to displace the lens shaft or the wheel shaft to change the center distance in response to output generated by the contour copying operation of the follower roller. For instance, the center distance changing device as disclosed in Japanese Publication Patent Nos. 46817/1980 and 46818/1980 and Japanese Laid-Open Patent No. 181556/1983 each of which was filed by the applicant of the invention, may be employed for the apparatus of the invention.

Since the apparatus of the invention is operated to grind a lens blank in accordance with information stored on a magnetic sheet with respect to the configuration of a lens frame as described above, it is possible to carry out repeated grinding operations at a high dimensional accuracy without any necessity for an original pattern. Thus, a number of lens blanks can be economically ground at a high operational efficiency merely by means of a single magnetic sheet required therefor. When a pair of lenses to be fitted to a lens frame are ground in the symmetrical relation, information stored on a magnetic sheet with respect to the contour line can be used for both lenses but the motor 14 is rotated in the opposite direction for each of them. Thus, they can be ground at a high operational efficiency.

While the present invention has been described above with respect to a single preferred embodiment, it should of course be understood that it should not be limited only to this but various changes or modifications may be made in any acceptable manner without departure from the spirit and scope of the invention as defined by the appended claims.

What is claimed is:

1. In an apparatus for grinding a lens blank to the predetermined configuration of a lens frame to which the lens is to be fitted, said apparatus includes a grinding wheel adapted to be rotated at a high rotational speed to grind said lens blank, a wheel shaft for mounting said grinding wheel thereon and first and second lens shafts adapted to clamp said lens blank therebetween, the axis of said lens shafts extending in parallel with the axis of said wheel shaft and rotating at a low rotational speed, wherein at least one of the wheel shaft and the lens shafts is adapted to move toward and away from the other, the improvement comprising;

a writing means for scribing a band of magnetized zone on a magnetic sheet including a first arm having a follower roller which is adapted to roll on a V-shaped groove of a lens frame, said magnetized zone having a contour line corresponding to the configuration of said V-shaped groove of said lens frame, a reading means for reading said contour line of said magnetized zone on said magnetic sheet said reading means including a second arm having a plurality of hole elements for reading said contour line, a center distance changing means for changing the distance between both said wheel shaft and said lens shafts in response to changing of the configuration of said contour line read by said reading means, and a control means for controlling operations of each of said writing means, reading means and distance dhanging means.

2. An apparatus as defined in claim 1, wherein said writing means includes a first arm and a third arm, said first arm being turnably supported on the apparatus to turn between a waiting position located outwardly of said contour line and a working position where said magnetic sheet is magnetized to a first polarity by means of a writing magnet carried on a free end of said first arm to scribe a band of magnetized zone and said third arm being turnably supported on said apparatus to turn between a waiting position located outwardly of said magnetic sheet and a working position located at the center of said magnetic sheet to magnetize said magnetic sheet to a second polarity which is reverse to said first polarity of said magnetized zone, and said third arm further including a demagnetizing magnet.

3. An apparatus as defined in claim 2, wherein said writing magnet is carried on said first arm in alignment with said follower roller adapted to roll on said V-shaped groove of said lens frame and has the same diameter as that of said follower roller, the configuration of the contour line of the magnetized zone corresponding to that of said lens frame.

4. An apparatus as defined in claim 2, wherein said magnetic sheet is first magnetized to said second polarity by means of said demagnetizing magnet of said third arm and said magnetic sheet is then magnetized to said polarity by means of said writing magnet on said first arm.

5. An apparatus as defined in claim 1 wherein the center of the magnetic sheet is located in correct alignment with the axis of the wheel shaft.

6. An apparatus as defined in claim 1, wherein said reading means includes a first hole element attached to a first bifurcated end part of said second arm to detect movement of the latter in the axial direction, and a second hole element attached to a second bifucated end part of said second arm, to detect turning movement of the latter, said first hole element being located in the longitudinal direction of said second arm, and an opposing pair of output electrodes located in the transverse direction of the same and said second hole element being located at a right angle relative to said magnetic sheet and including an opposing pair of input electrodes located in the longitudinal direction of said second arm and an opposing pair of output electrodes located at a right angle relative to the same.

7. An apparatus as defined in claim 1, wherein the center distance changing means includes a moving block with a motor mounted thereon to displace said lens blank toward and away from said grinding wheel, an output shaft for turning said second arm, and said first lens shaft being rotatably fitted to said output shaft.

8. An apparatus as defined in claim 7, wherein said output shaft is operatively connected to a motor which is rounted on said moving block to turn said second arm.

9. An apparatus as defined in claim 2, wherein the center of said magnetic sheet is located in alignment with the axis of said wheel shaft.

10. An apparatus as defined in claim 3, wherein the center of said magnetic sheet is located in alignment with the axis of said wheel shaft.

11. An apparatus as defined in claim 4, wherein the center of said magnetic sheet is located in alignment with the axis of said wheel shaft.

* * * * *